US005262702A

United States Patent [19]

Shimoma et al.

[11] Patent Number: 5,262,702

[45] Date of Patent: Nov. 16, 1993

[54] COLOR CATHODE-RAY TUBE APPARATUS

[75] Inventors: Taketoshi Shimoma, Isesaki; Eiji Kamohara, Fukaya; Shigeru Sugawara, Kamisato; Jiro Shimokobe, Fukaya, all of Japan

[73] Assignee: Kabushiki Kaisha Toshiba, Kawasaki, Japan

[21] Appl. No.: 864,128

[22] Filed: Apr. 6, 1992

Related U.S. Application Data

[63] Continuation of Ser. No. 497,917, Mar. 23, 1990, abandoned.

[30] Foreign Application Priority Data

Mar. 23, 1989 [JP] Japan ..... 1-69320
Oct. 3, 1989 [JP] Japan ..... 1-257091

[51] Int. Cl.[5] ..... G09G 1/04; H01J 29/50
[52] U.S. Cl. ..... 315/382; 313/414
[58] Field of Search ..... 315/382, 14, 370; 313/414

[56] References Cited

U.S. PATENT DOCUMENTS 4,009,410 2/1977 Pomier et al. .
4,277,722 7/1981 Hawken et al. ..... 315/382
4,468,587 8/1984 Sluyterman ..... 313/414
4,528,476 7/1985 Alig .
4,641,058 2/1987 Koshigoe et al. ..... 313/414
4,678,964 7/1987 Peels .
4,737,682 4/1988 Alig et al. .
4,742,279 5/1988 Gerritsen .
4,814,670 3/1989 Suzuki et al. ..... 315/15
4,877,998 10/1989 Maninger et al. ..... 315/15

FOREIGN PATENT DOCUMENTS 0104674 4/1984 European Pat. Off. .
0231964 8/1987 European Pat. Off. .
57-30247 2/1982 Japan .
61-74246 4/1986 Japan .
1-29298 6/1989 Japan .

*Primary Examiner*—Gregory C. Issing
*Attorney, Agent, or Firm*—Cushman, Darby & Cushman

[57] ABSTRACT

In an electron gun assembly, electron beams emitted from cathodes are focused in first cross-over and accelerated and controlled by grids along three axes arranged in-line. The controlled electron beams are weakly converged by unipotential lenses and are converged in a vertical plane by a common single electron lens having a lens power which is varied in accordance with a horizontal or vertical deflection of the electron beams. The converged electron beams form second cross-over on the axes which are shifted along the axes are diverged from the second cross-overs. The diverged electron beams are further focused and converged onto a screen by a main lens.

15 Claims, 12 Drawing Sheets

COLOR CATHODE-RAY TUBE APPARATUS

This is a continuation of application Ser. No. 07/497,917, filed on Mar. 23, 1990, which was abandoned upon the filing hereof.

BACKGROUND OF THE INVENTION

1. Field of the Invention

The present invention relates to a color cathode-ray tube apparatus and, more particularly, an electron gun assembly for use in a color cathode-ray tube apparatus, which dynamically focuses electron beams, thereby forming a high-resolution image on the phosphor screen of the color cathode-ray tube apparatus.

2. Description of the Related Art

FIG. 1 is a cross-sectional view of a color cathode-ray tube apparatus of the most common type. As is shown in this figure, the color cathode-ray tube apparatus comprises a faceplate 3, a funnel 4, a neck 5, an electron gun assembly 6, a deflection unit 7, and a shadow mask 9. The faceplate 3 has an edge portion 3*a*. A screen 2 is formed on the inner surface of the faceplate 3. The funnel 4 connects the edge portion 3*a* of the faceplate 3 to the neck 5. The electron gun assembly 6 is located within the neck 5. The deflection unit 7 is shaped like a ring, surrounding the junction of the funnel 4 and the neck 5. The unit 7 is designed to deflect the electron beams emitted by the electron gun assembly 6. The shadow mask 9 is held in the faceplate 3 and opposes the screen 2, spaced apart therefrom by a predetermined distance. The mask 9 has a number of apertures 8 for guiding the electron beams onto the screen 2. The color cathode-ray tube apparatus further comprises an inner conductive layer 10 and an anode terminal (not shown). The layer 10 is coated uniformly on the inner surface of the funnel 4 and also on a part of the inner surface of the neck 5. The anode terminal (not shown) is mounted on a part of the inner surface of the funnel 4.

Red phosphor, green phosphor, and blue phosphor are coated on the screen 2 in the form of stripes or dots. The electron gun assembly 6 emits three electron beams BR, BG, and BB. The beams BR, BG, and BB are deflected by the deflection unit 7, guided by the shadow mask 9, and applied onto the phosphor stripes or dots. When excited by these electron beams, the red phosphor stripes or dots emit red light, the green phosphor stripes or dots emit green light, and the blue phosphor stripes or dots emit blue light.

The electron gun assembly 6 has a beam-forming section GE and a beam-processing section ML. The section GE generates three parallel electron beams BR, BG, and BB in so-called "in-line alignment," and accelerates and controls these beams. The beam-processing section ML focuses and converges the three electron beams emitted from the beam-forming section GE. The electron beams BR, BG, and BB emitted from the electron gun assembly 6 are deflected by means of the deflection unit 7, guided by the shadow mask 8, and applied onto the screen 2. Hence, the electron beams scan the screen 2, forming rasters on the screen 2.

The deflection unit 7 has a horizontal deflection coil and a vertical deflection coil. The horizontal deflection coil generates a horizontal-deflection magnetic field for deflecting the electron beams in the horizontal direction. The vertical deflection coil generates a vertical-deflection magnetic field for deflecting the electron beams in the vertical direction.

When any beam emitted from the electron gun assembly 6 is deflected by means of the deflection unit 7, it cannot be correctly converged and thus fails to form a beam spot on the target phosphor stripe or dot formed on the screen 2. To converge the beam with accuracy, the so-called "convergence-free system" is used in the conventional cathode-ray tube apparatus. In this system, the horizontal-deflection magnetic field is formed into a pincushion-shape, and the vertical-deflection magnetic field is formed into a barrel-shape. The pincushion magnetic field and the barrel magnetic field act, in concert, on the three electron beams such that the beams are correctly converged on the target phosphor stripes or dots, respectively.

Generally, even a magnetic field, which is considered to be uniform in its intensity distribution, includes a small pincushion component or a small barrel component. FIG. 2A schematically shows a magnetic field including a pincushion component. An electron directed to the peripheral portion of the screen 2, in particular, is subjected to a relatively prominent deflection aberration as the beam passes through this magnetic field. Consequently, when the beam lands on the peripheral portion of the screen 2, it forms a beam spot which is distorted as is shown in FIG. 2B. The distorted beam spot consists of a horizontally elongated core having high luminance and halos having low luminance, one extending upward from the core and the other extending downward from the core. The larger the cathode-ray tube apparatus, or the more the beam is deflected, the more the beam spot is distorted.

This distortion of the beam spot is produced due to over-focusing of the electron beam in the vertical plane. A method of reducing or eliminating the deflection aberration, i.e., the cause of the distortion of the beam spot, is disclosed in Television Technology, Vol. 36, pp. 41–55, 1988. This method is characterized in that a quadruple lens is incorporated into an electron gun assembly, and is driven to emit an electron beam having a cross section whose upper and lower portions are more intense than the right and left portions. When this method is applied, however, an electron beam will have an elliptical cross section extending in the vertical direction, and will be subjected to a more prominent aberration. Thus, in order to focus the electron beam appropriately, the power of the electron lens must be changed greatly. Here arises a problem. The more the power of the lens is varied, the greater the changes in the voltage for achieving dynamic focusing of the beam, and, hence, the greater circuit load the cathode ray tube apparatus requires.

Further, in the quadruple lens, the electron beam is excessively diverged in the vertical plane and the electron beam is excessively focused in the horizontal direction. It is therefore necessary to add to the lens some elements for correcting this over-focusing of the electron beam, which would render the lens more complex in structure. To control such a complex electron lens, the circuit for controlling the electron gun assembly needs to be complex inevitably.

Japanese Laid Open Patent Application No. 60-22140 discloses a cathode-ray tube apparatus, wherein electron beams are guided to cross twice the axis of the electron gun assembly, thereby to achieve a sufficient resolution even if the beam current is comparatively small. The gun assembly used in this apparatus comprises a three-electrode unit including a first grid G1 (i.e., the control electrode) and a second grid G2 (i.e., the shield electrode), a main lens electrode for forming a main electron lens, and an auxiliary electrode G2s. The electrode G2s is interposed between the three-electrode unit and the main-lens electrode, and is applied with a voltage which is lower than the voltage applied to the second grid G2 and changes in accordance with the desired deflection angle of the electron beam.

In this electron gun assembly, the electron beam crosses the axis of the assembly twice until it reaches the main lens electrode, and its peripheral portion is trimmed by a trimming electrode as the beam travels from the main lens electrode to the phosphor screen. The beam, however, forms but a distorted spot on the phosphor screen due to the deflection aberration, though the image resolution is sufficiently high if the beam current is relatively small. This is because the beam is anisotropically distorted by the deflection magnetic field, and the anisotropic distortion cannot be eliminated since the beam crosses the axis of the gun assembly two times while traveling from the cathode to the main lens electrode. Moreover, even if the second cross-over is dynamically shifted on the axis of the gun assembly, the shape of the second cross-over is changed in the horizontal or vertical plane, due to the auxiliary electrode G2s which are located between the cathode and the third grid G3, or within the beam-forming section of the gun assembly. Hence, the deflection aberration cannot be either reduced or eliminated in the cathode-ray tube, wherein self-convergence deflection magnetic fields are generated. Rather, the deflection aberration increases, and the beam will form an even more distorted spot on the phosphor screen.

The electron lens is located in the beam-forming section of the gun assembly, in order to make the beam cross the axis of the gun assembly for the second time. This electron lens comprises four thin electrodes. These electrodes are located so close to one another that their potential affect mutually to a degree which depends on the shapes of the electrodes and also those of the openings made in the electrodes. Consequently, the characteristics of the electron lens fluctuate. Due to the fluctuation of its characteristics, the lens can hardly focus an electron beam sufficiently in the vertical direction only. Rather, this quadruple lens may focus an electron beam more in the horizontal direction than in the vertical direction.

As may be clear from the above, the larger the color cathode-ray tube apparatus, or the more the electron beam are deflected, the more the resultant image will be deteriorated.

SUMMARY OF THE INVENTION

The object of the present invention is to provide a color cathode-ray tube apparatus wherein, although electron beams are subjected to deflection aberration, they are focused such that beam spots, distorted as little as possible, are formed on the phosphor screen, thereby forming a high-quality image on the entire phosphor screen.

According to a first aspect of this invention, there is provided an electron gun assembly having three gun axes aligned in a horizontal plane and designed to emit electron beams which are to be deflected in both a horizontal plane and a vertical plane and then applied to a phosphor screen, said assembly comprising: means for emitting three electron beams arranged in-line along the three gun axes, respectively, and accelerating and controlling the electron beams emitted from said emitting means; first electron lens means for focusing the electron beams, having a lens power which is greater in the vertical plane than in the horizontal plane, thereby causing the three electron beams to cross the gun axes only in the vertical plane and form cross-overs on the gun axes; second electron lens means for focusing the electron beams; and cross-over shifting means for changing vertical-focusing power supplied to the first electron lens means, in accordance with the horizontal or vertical deflection of the electron beams, thereby shifting the cross-overs on the gun axes between the first electron lens means and the second electron lens means.

According to a second aspect of the invention, there is provided an electron gun assembly having three gun axes aligned in a horizontal plane and designed to emit electron beams which are to be deflected in both a horizontal plane and a vertical plane and then applied to a phosphor screen, said assembly comprising: three cathodes arranged in in-line alignment for emitting three electron beams along the three gun axes, respectively; control electrode means having three round through holes and held at a predetermined potential, for accelerating and controlling the electron beams which have been emitted by the cathodes; first electrode means including electrodes each having three holes spaced apart in a horizontal direction, for guiding electron beams, one of said electrodes being applied with a potential changed in accordance with a deflection of the electron beam , and the remaining electrode means having one through hole for guiding the three electron beams, for focusing the electron beams and also converging the electron beams while the beams are traveling toward the phosphor screen.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

An embodiment of the present invention will now be described, with reference to FIGS. 3 to 8.

Figure 1:
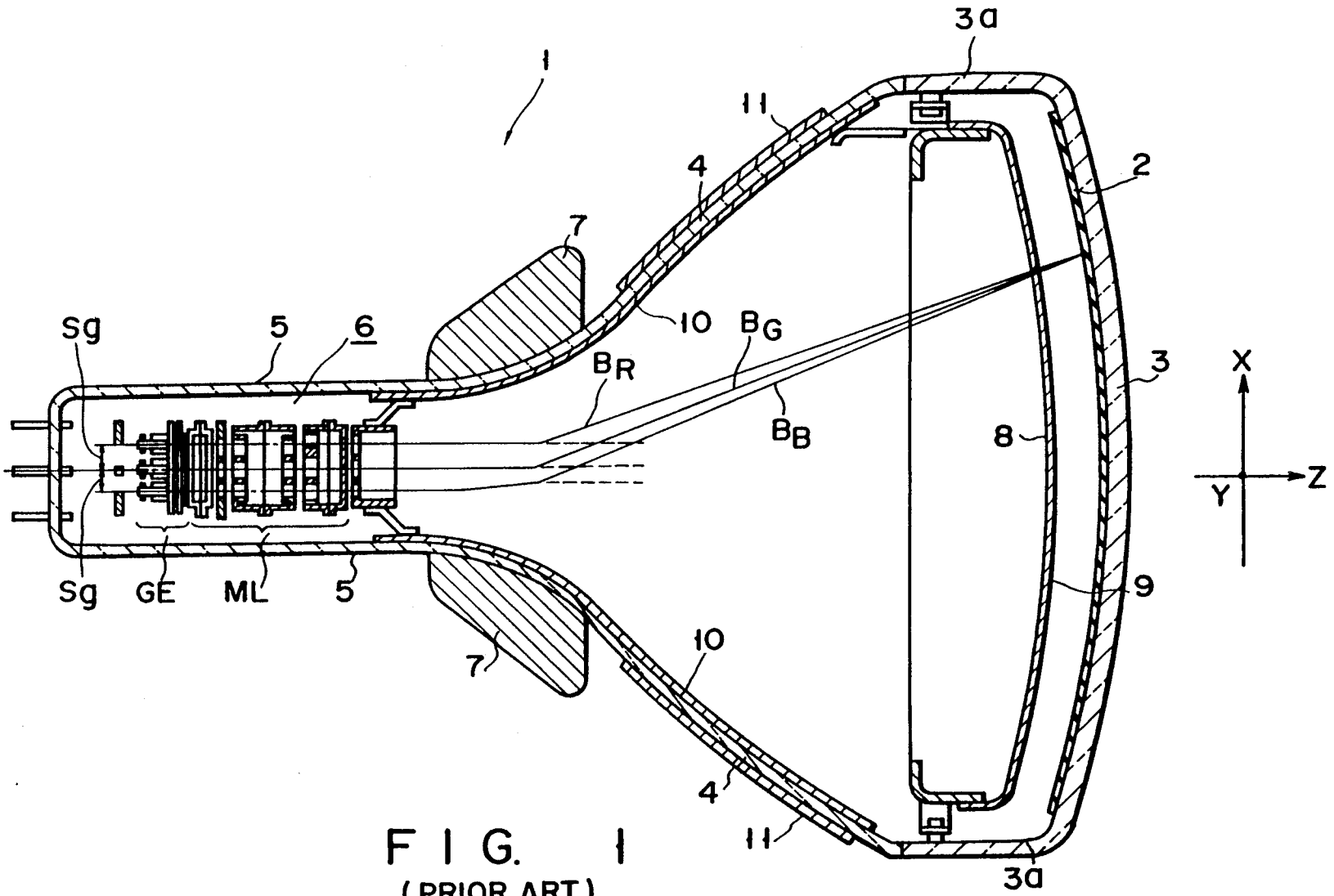
FIG. 1 (PRIOR ART)
FIG. 1 is a longitudinal sectional view showing a conventional color cathode-ray tube apparatus.
Figure 2A:
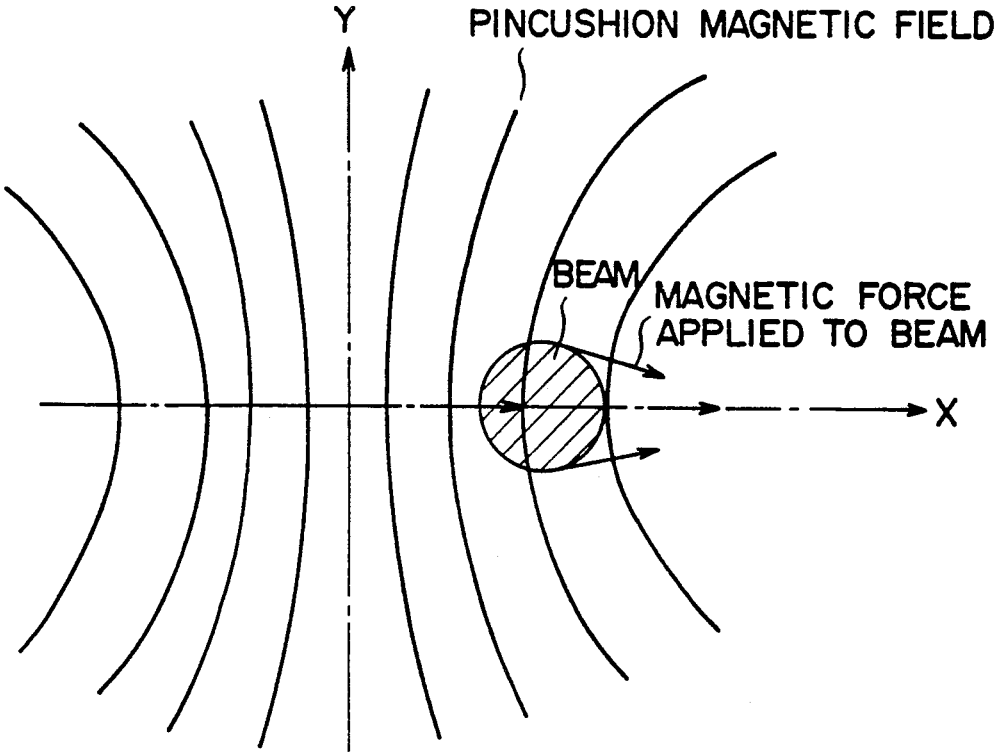
FIG. 2A (PRIOR ART)
FIGS. 2A and 2B are schematic diagrams explaining why an electron beam forms a distorted spot on a phosphor screen when it is subjected to deflection aberration.
Figure 2B:
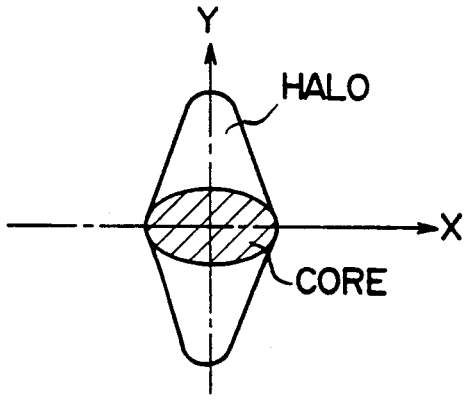
FIG. 2B (PRIOR ART)
Figure 3:
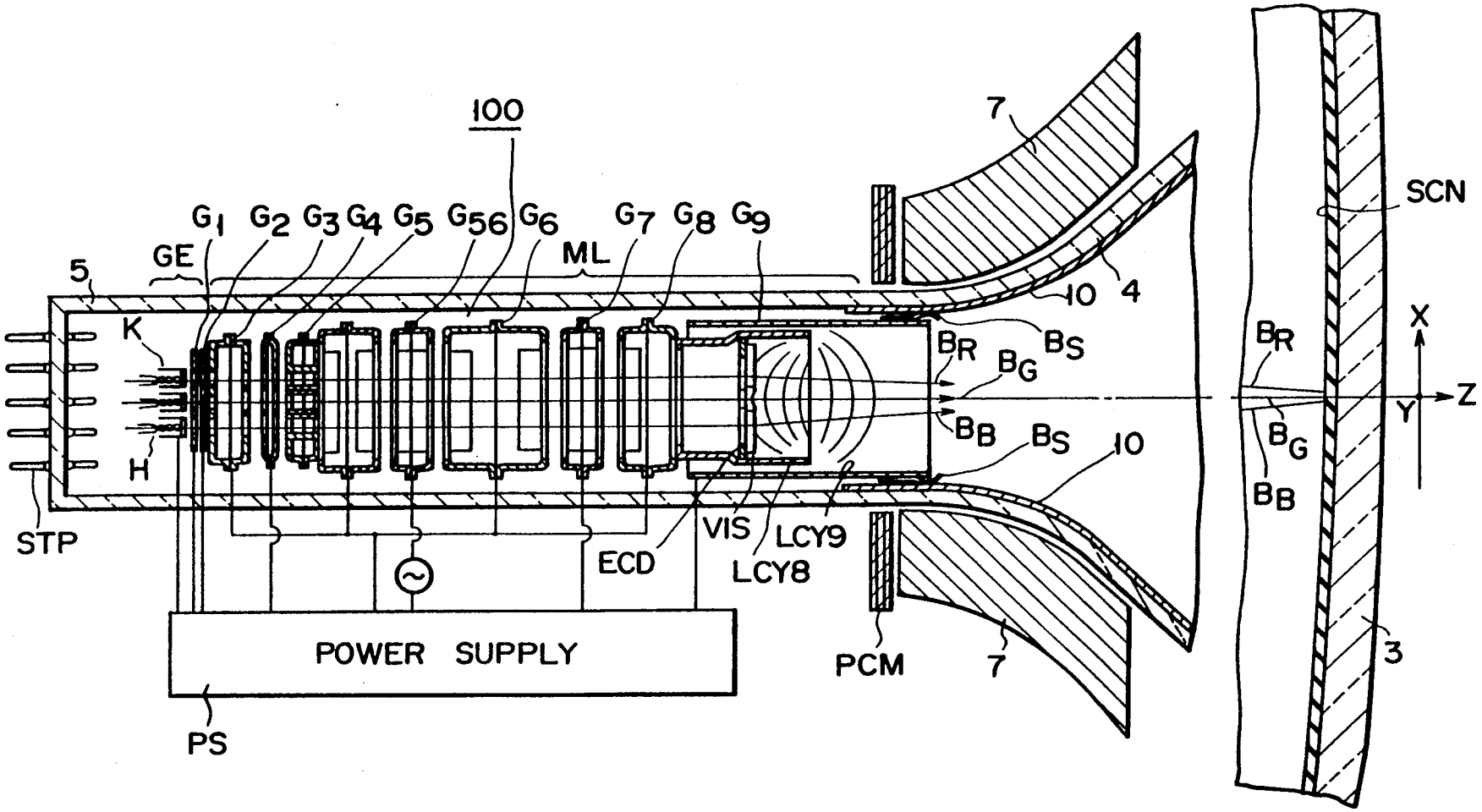
FIG. 3 is a longitudinal sectional view illustrating a color cathode-ray tube apparatus according to an embodiment of the present invention.
Figure 4:
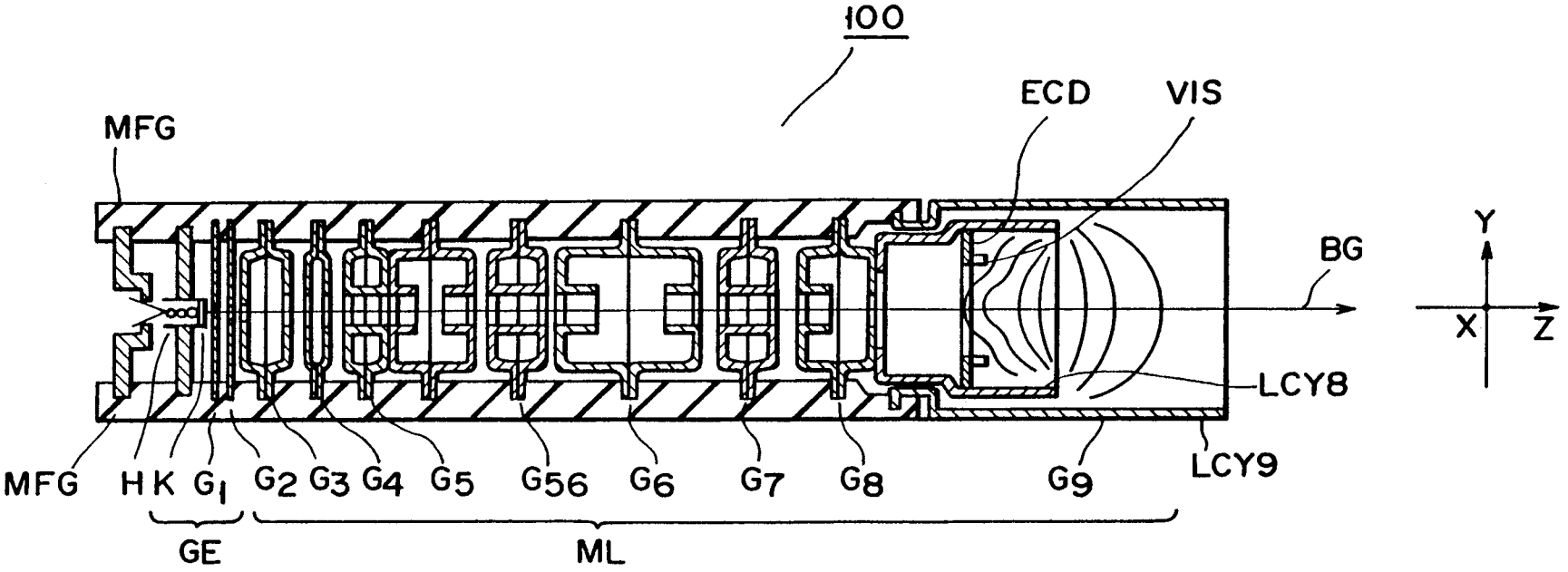
FIG. 4 is a sectional view showing the electron gun assembly incorporated in the apparatus illustrating in FIG. 3.

FIG. 3 is a longitudinal sectional view of a color cathode ray-tube apparatus according to the invention, taken along X-Z plane, i.e., the horizontal plane. FIG. 4 is also a longitudinal sectional view of the electron gun assembly incorporated in the apparatus, taken along Y-Z plane, i.e., the vertical plane.

As is shown in FIGS. 3 and 4, an electron gun assembly 100 of in-line type is incorporated in the neck 5 of the color cathode-ray tube apparatus. The assembly 100 comprises an insulated support rod MFG, three cathodes K, a first grid G1, a second grid G2, a third grid G3, a fourth grid G4, a fifth grid G5, an auxiliary grid G56, a sixth grid G6, a seventh grid G7, an eighth grid G8, and a ninth grid G9. The nine grids and the auxiliary grid are supported by the support rod MFG, and are arranged in a line, from the cathodes K toward the screen SCN in the order they are mentioned. A bulb spacer BS is mounted on the ninth grid G9 and contacts the inner surface of the neck 5, thus holding the grid G9 in place. The electron gun assembly 100 is fixed to the neck 5 by means of stem pins STP.

The cathodes K each contain a heater H each, and emits three electron beams BR, BG, and BB when the heaters H generate heat. The first grid G1 and the second grid G2 have three, relatively small holes each. The three holes of either grid guide the electron beams BR, BG, and BB. The third grid G3 is a hollow, thin member made of two parallel plates which are spaced apart for a short distance and connected together at both ends. The plate of the grid G3, which opposes the second grid G2, has three beam-guiding holes, which are larger than those of the second grid G2. The cathodes K, the first grid G1, the second grid G2, and the third grid G3 constitute an electron beam-forming section GE for controlling and accelerating electron beams.

Figure 5A:
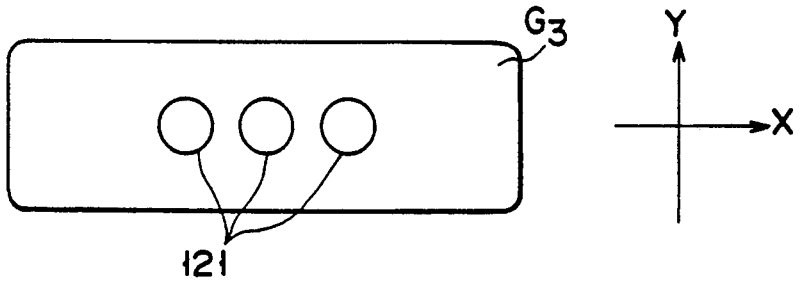
FIGS. 5A, 5B and 5D schematically show the electrodes used in the electron gun assembly shown in FIG. 4.
Figure 5B:
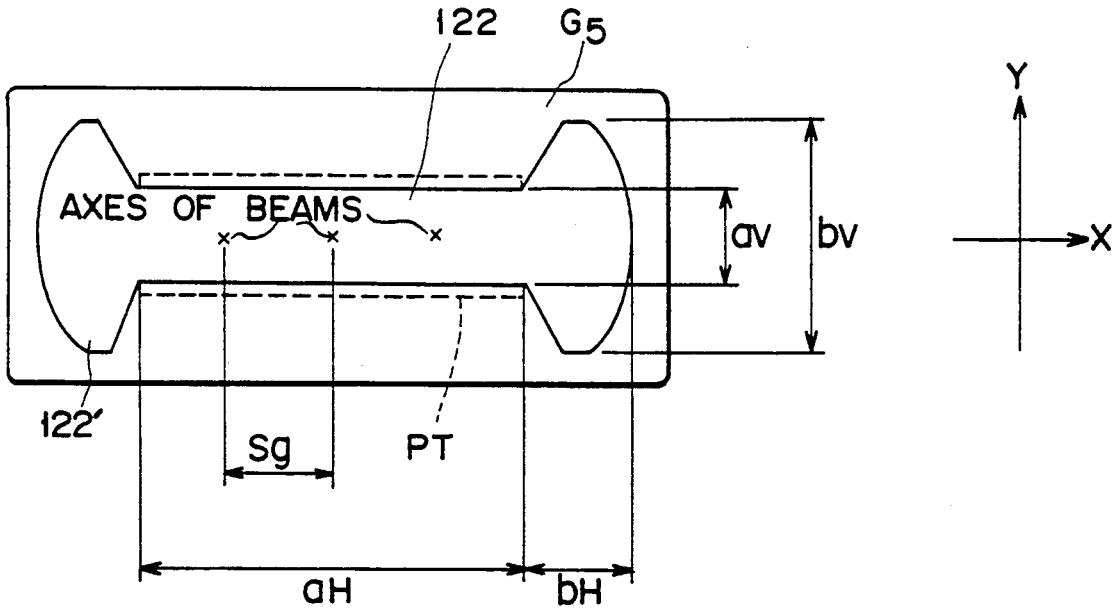

As is illustrated in FIG. 5A, that plate of the third grid G3, which opposes the fourth grid G4, has three, relatively large beam-guiding holes 121. The fourth grid G4 is a hollow, thin member made of two parallel plates each having three beam-guiding holes which have the same diameter as the beam-guiding holes 121. The fifth grid G5 is also a hollow, thin member made of two parallel plates. The plate of the fifth grid G5, which opposes the fourth grid G4, has three beam-guiding hoes having the same diameter as the holes 121 of the third grid G3. The plate of the fifth grid G5, which opposes the auxiliary grid G56, has one hole 122 for guiding the three electron beams BR, BG, and BB. As is shown in FIG. 5B, the beam-guiding hole 122 is elongated in the X direction. The fifth grid G5 has projections PT extending in the Z direction in the electrode structure. The auxiliary grid G56, the sixth grid G6, and the seventh grid G7 have one beam-guiding hole each, which is elongated in the X direction like the hole 122 of the fifth grid G5. The auxiliary grid G5 also has projections PT extending in the Z direction in the electrode structure.

Figure 5C:
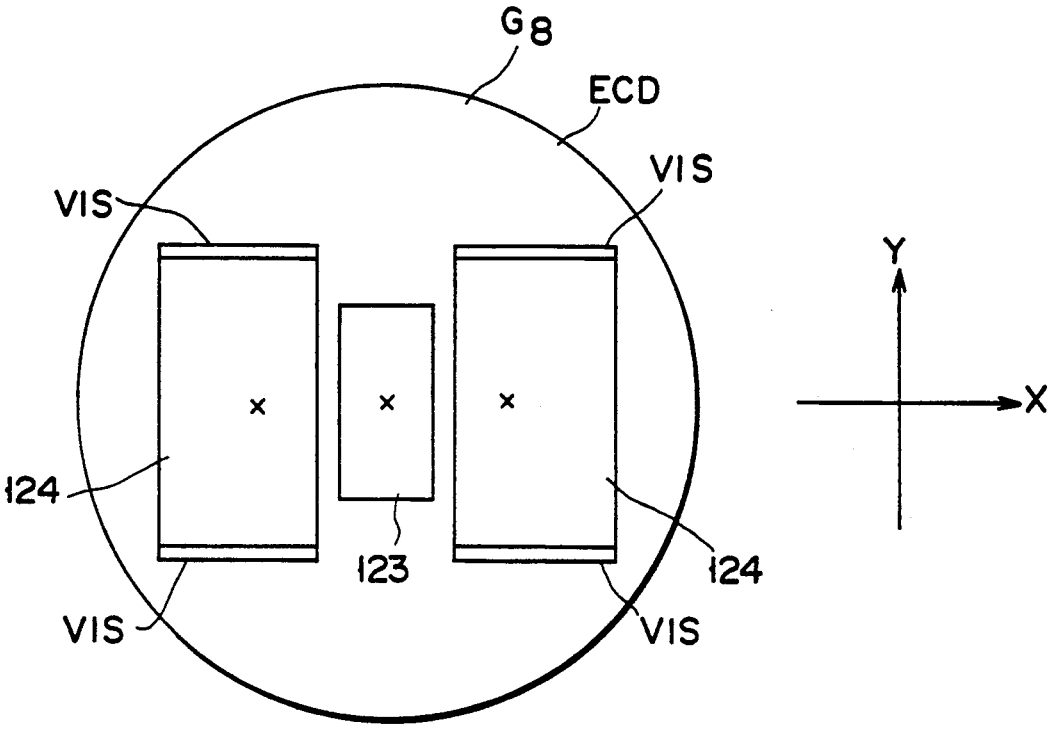
FIG. 5C is a cross-sectional view illustrating the electric field control plate incorporated in the electron gun assembly.

The eighth grid G8 is a hollow, thin member made of two parallel plates, both having one beam-guiding hole which is elongated in the X direction. A hollow cylinder LCY 8 is connected to that plate of the grid G8 which opposes the phosphor screen. An electric field control plate ECD is located in the hollow cylinder LCY, dividing the interior of the cylinder LCY into two portions. As is shown in FIG. 5C, the plate ECD has three rectangular beam-guiding holes extending in the Y direction, i.e., a center hole 123 and two side holes 124 larger than the center hole 123. Two projections VIS extend in the Z direction from those portions of the plate ECD which are located at the upper end lower edges of either side beam-guiding hole 124.

The ninth grid G9 is a large hollow cylindrical electrode LCY 9 which surrounds the eighth grid G8. An electron lens LEL is formed between the eighth grid G8 and the ninth grid G9. The bulb spacer BS is mounted on the front-end portion of the ninth grid G9. The spacer is electrically and mechanically contacts a conductive layer 10 coated on the inner periphery of the junction between the funnel 4 and neck 5 of the cathode-ray tube apparatus. A high anode voltage is applied to the ninth grid G9 via the layer 10 and the bulb spacer BS from an anode terminal (not shown) mounted on the funnel 4. Predetermined voltages are applied to all other grids from the external voltage sources PS through the stem pins STP.

As evident from FIG. 4, the cathodes K, the grids G1 to G9, and the auxiliary grid G56 are secured to the insulated support rod MFG. As is shown in FIG. 3, a deflection yoke 7 is mounted on the junction of the funnel 4 and the neck 5. The yoke 7 comprises a horizontal deflection coil and a vertical deflection coil The horizontal deflection coil deflects the electron beams BR, BG, and BB emitted from the gun assembly, in the horizontal direction. The vertical deflection coil deflects the beams BR, BG, and BB in the vertical direction. A multi-pole magnet PCM is mounted on the neck 5 and located close to the deflection yoke 7, for adjusting the paths of the electron beams BR, BG, and BB.

In operation, a cutoff voltage of 150 kV is applied to the cathodes K, and video signals are also supplied to the cathodes K. The first grid G1 is maintained at the ground potential, whereas a voltage of 500 V to 1 kV is applied to the second grid G2. Voltages of 5 kV to 10 kV are applied to the grids G3, G5, G6, and G8; a voltage of 0 V to 1 kV is applied to the fourth grid G4; a voltage of 0 V to 3 kV is applied to the auxiliary grid G56; and a voltage of 15 to 20 kV is applied to the seventh grid G7. A voltage of 25 kV to 35 kV, which is equivalent to an anode voltage, is applied to the ninth grid G9.

Figure 6A:
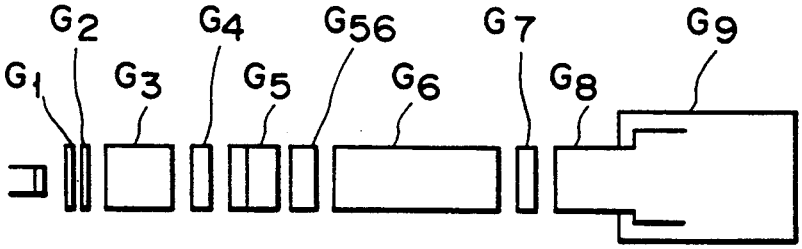
FIG. 6A is a diagram representing how the electrodes of the gun assembly ar arranged.
Figure 6B:
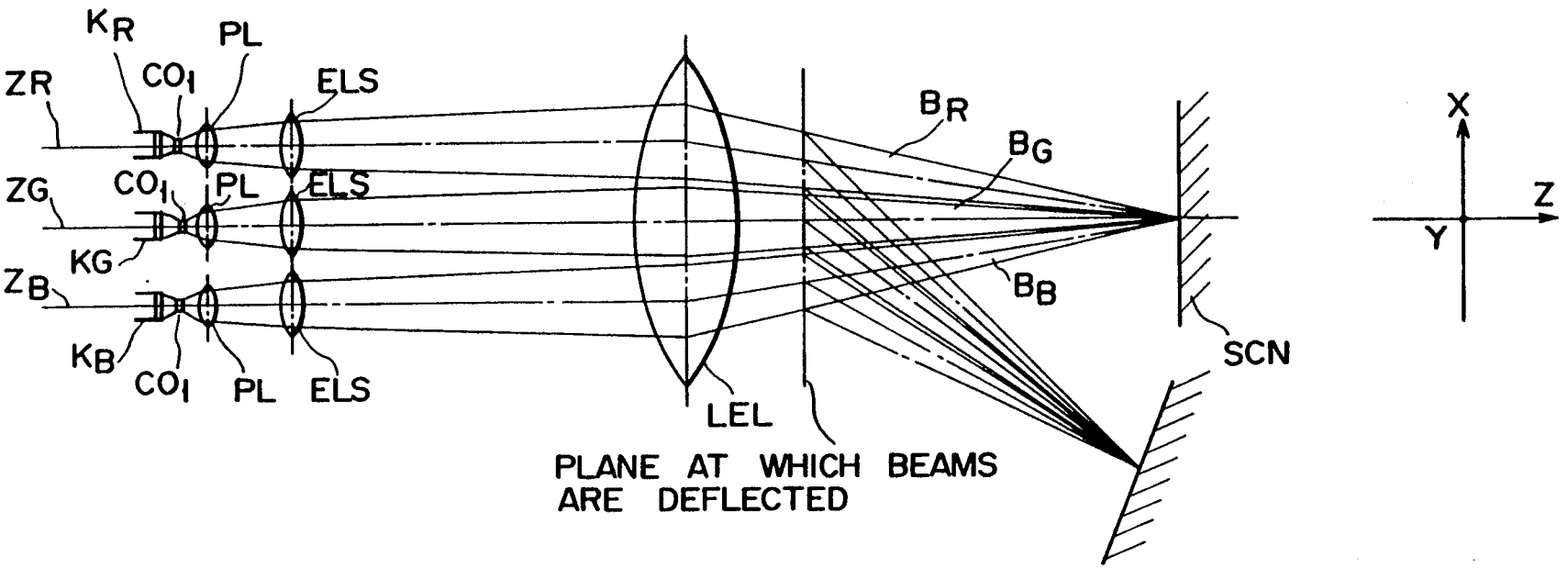
FIGS. 6B and 6C illustrate the optical models equivalent to the electron lenses constituted by the electrodes shown in FIG. 6A.
Figure 6C:
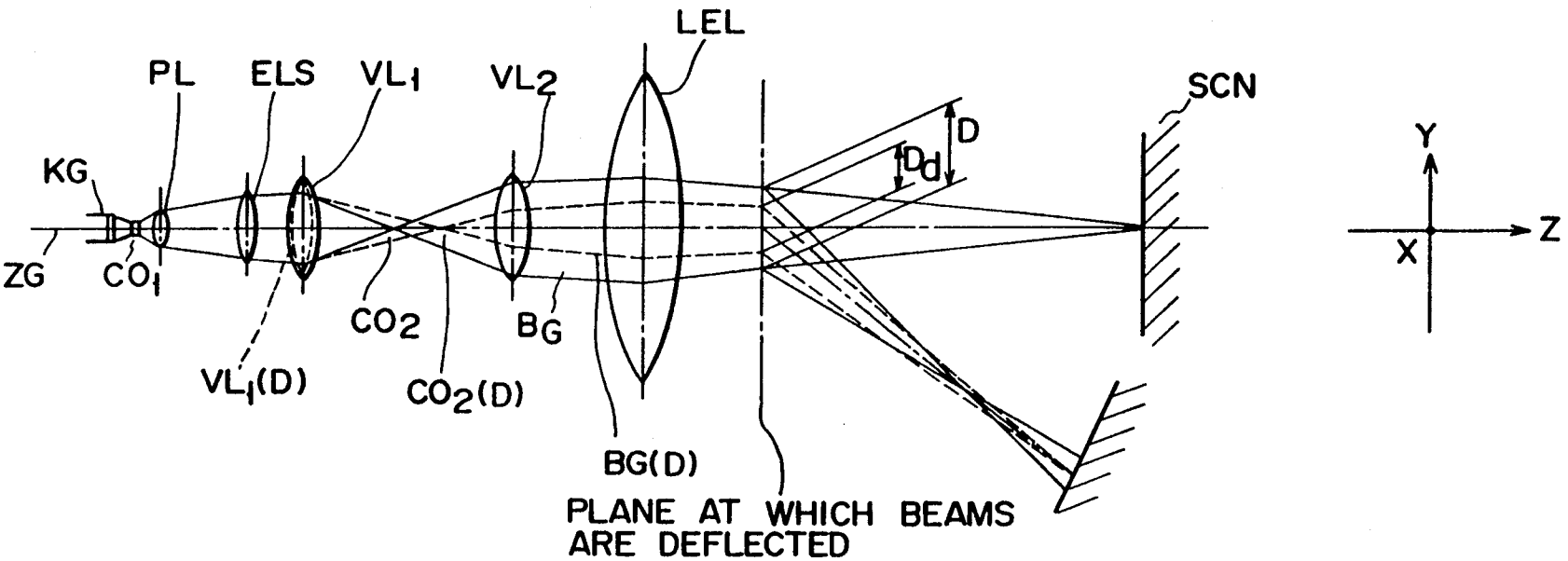
Figure 6D:
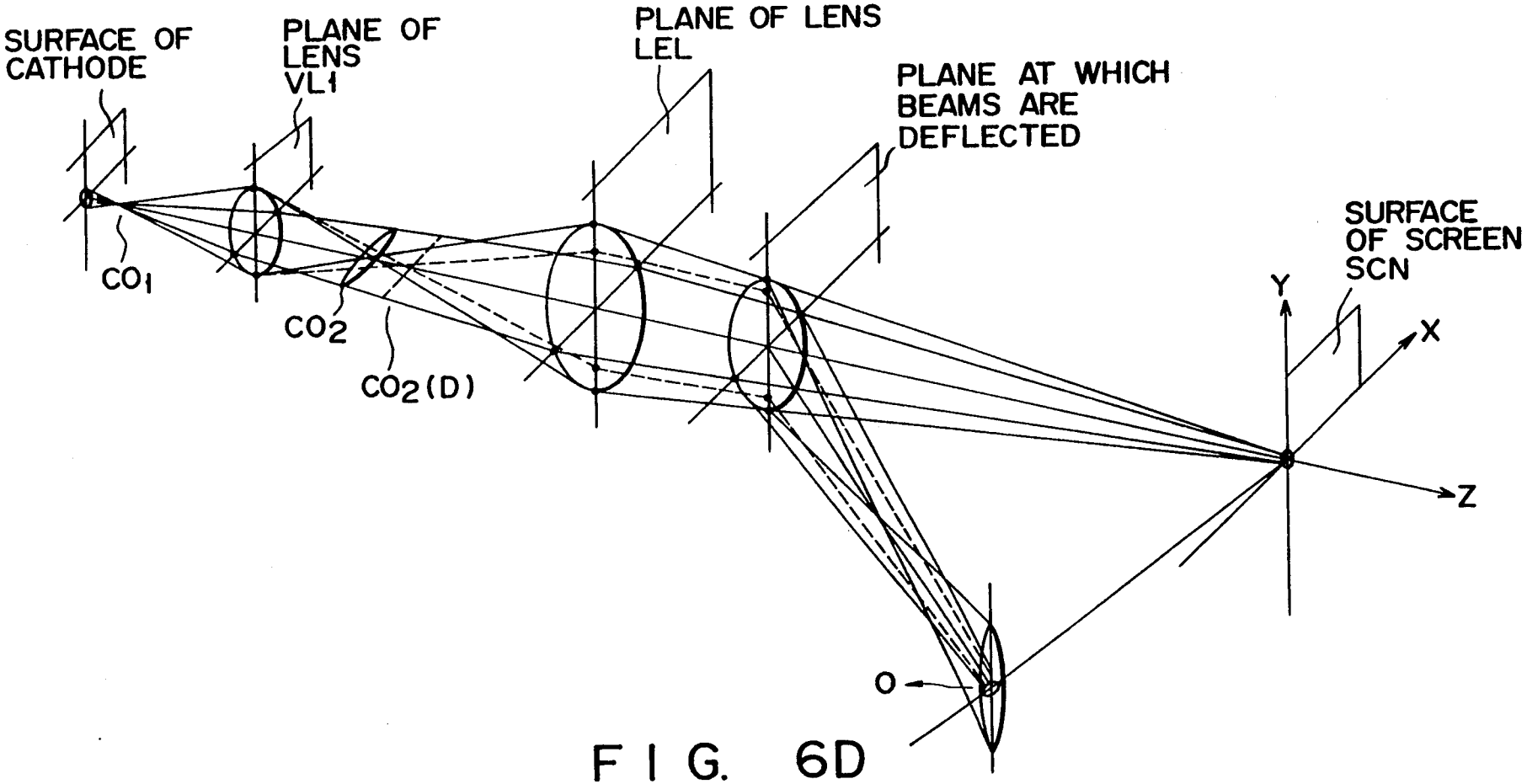
FIG. 6D is a diagram showing the paths in which electron beams pass through the major electron lenses shown in FIGS. 6B and 6C.

When the various voltages, specified above, are applied to the grids of the gun assembly from the power supply PS, an electron lenses are formed as is shown in FIGS. 6B and 6C. FIG. 6A illustrates only the grids of the gun assembly, more particularly showing the arrangement of these grids. FIG. 6B shows the positions which the electron lens assume in the horizontal plane, i.e., the X-Z plane. FIG. 6C shows the positions which the electron lens take in the vertical plane, i.e., the Y-Z plane. Further, FIG. 6D is a perspective view of the system comprised of some of the electron lenses shown in FIGS. 6B and 6C.

The cathodes K generate electron beams BR, BG, and BB in accordance with a video signals supplied to them. These electron beams are focused by the grids G1 and G2, thereby crossing gun axes ZR, ZG, and ZB at first cross-overs CO1. The beams are focused a little by prefocusing lenses PL formed between the grids G2 and G3, and is supplied to the third grid G3. The electron beams BR, BG, and BB pass through the third grid G3 and focused by unipotential lenses ELS as they pass through the fourth grid G4. They are further focused by a single electron lens LEL, as they pass through the grids G5 to G9. The electron beams BR, BG, and BB, thus focused, are deflected by the yoke 7 in both the horizontal direction and the vertical direction and applied to adjacent red, green and blue phosphor stripes or dots formed on the screen SCN.

As other video signals are supplied to the cathodes K, one after another, the electron beams BR, BG, and BB scan the phosphor screen SCN, forming a color image thereon. Whenever the deflection yoke 7 deflects the beams toward the peripheral portion of the phosphor screen SCN, each electron beam has a deflection aberration. The characteristics of the main electron lens LEL are changed to cancel out the deflection aberration, thereby to impart high quality to the color image.

The unipotential lenses ELS are defined by the round beam-guiding holes of the fourth grid G4, the beam-guiding holes of hat plate of the third grid G3 which opposes the grid G4, and the beam-guiding holes of that plate of the fifth grid G5 which opposes the grid G4. The lenses ELS focus the electron beams BR, BG, and BB, which are travelling from the first cross-over CO1 and passing through the third grid G3, a little in both the horizontal direction and the vertical direction.

The elongated beam-guiding hole of the auxiliary grid G56, the elongated beam-guiding hole of that plate of the grid G5 which faces the grid G56, and the elongated beam-guiding hole of that plate of the grid G6 which opposes the grid G56 define a single electron lens VL1. This lens VL1 focuses the electron beams BR, BG, and BB more in the vertical plane, i.e., the Y-Z plane, than in the horizontal plane, i.e., the X-Z plane. As is shown in FIG. 6C, the beams cross the gun axes in the vertical plane in the middle portion of the sixth grid G6, thus forming second cross-over CO2. The beams diverge from the second cross-over CO2 toward the seventh grid G7.

The elongated beam-guiding hole of the grid G7, the elongated beam-guiding hole of that plate of the grid G6 which opposes the grid G7, and the elongated beam-guiding hole of that plate of the grid G8 which opposes the grid G7 define a single electron lens VL2. This electron lens VL2 focuses the beams a little in the vertical plane and applied to the single electron lens LEL which is defined by the grids G8 and G9. The electron lens LEL focuses the beams BR, BG, and BB in both the horizontal plane and the vertical plane onto the center portion of the phosphor screen SCN. As the electron beams land on the screen SCN, they form small beam spots.

Figure 7:
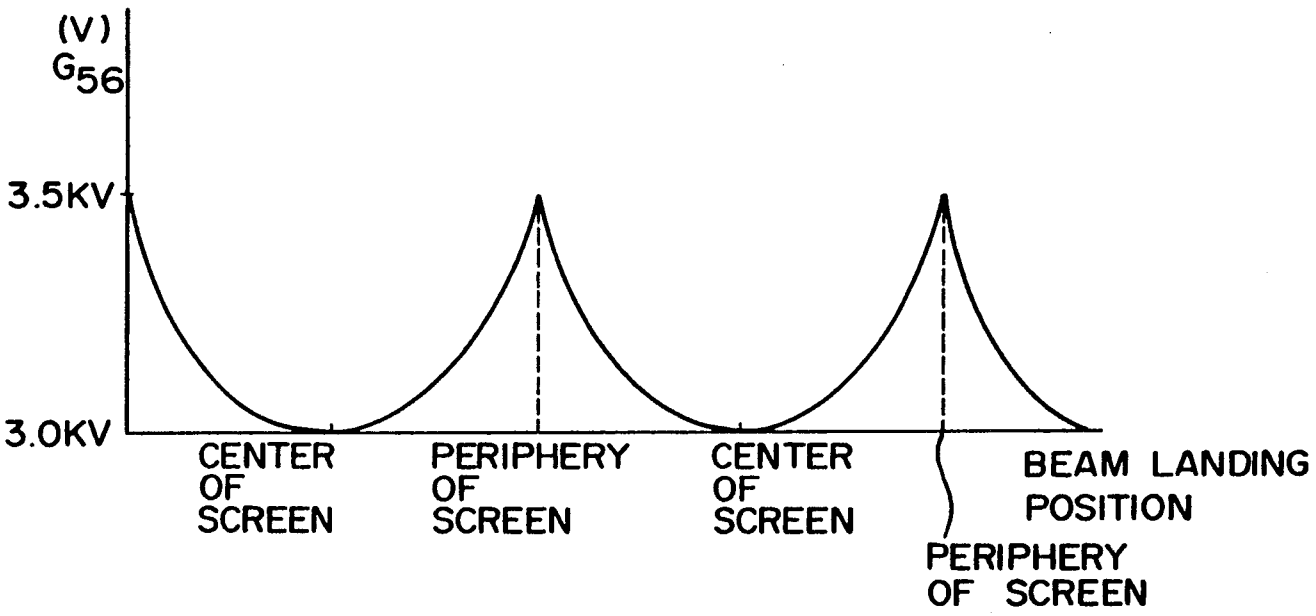
FIG. 7 is a graph representing the relationship between the voltage applied to the auxiliary grids shown in FIGS. 3 and 4 and the landing position of an electron beam lands.

If the electron beams focused by the lens LEL ar deflected by the deflection yoke 7 generating a magnetic field of the self-convergence type, they will be focused excessively in the vertical plane as has been mentioned earlier. To prevent such an over focusing of the beams, the potential of the auxiliary grid G56 is increased as is illustrated in FIG. 7 in accordance with the voltage applied to the auxiliary grid G56 from the power source PS. When the potential of the grid G56 is increased, the vertical-focusing power of the cylindrical electron lens VL1 decreases as is indicated by the broken line in FIG. 6C, and the second cross-over CO2 shifts to position CO2(D). As a result, the distance between the lens LEL and the objective point, measured in the vertical direction, becomes shorter, thereby preventing the over-focusing of the beams. Therefore, the beams are focused appropriately onto the peripheral portion of the screen SCN. In other words, dynamic focusing is achieved by changing the potential of the auxiliary grid G56.

Although only the center beam BG is shown in FIG. 6C, the side beams BR and BB are dynamically focused in the same way as the center beam BG. As can be understood from FIG. 6C, when the beams being applied to the peripheral portion of the screen SCN are dynamically focused, the diameter they have in the deflection start plane decreases from D to Dd. By virtue of the small diameter Dd of the beams, the beams have little deflection aberration. Hence, the dynamic focusing helps to form a high-quality image on the phosphor screen SCN. In this embodiment, the second cross-over may be formed at a position between the lens VL2 or LEL and the screen to obtain a same advantage.

FIG. 6D is a perspective view showing the major electron lens which act on the center beam BG. The electron lens VL1, which is defined by the grids G5, G56, and G6, focuses the beam BG more in the vertical plane than in the horizontal plane. As a result, a line-like second cross-over CO2 is formed, where the beam BG crosses the gun axis in front of the electron lens LEL. The lens VL1 is designed to focus three electron beams to the same degree. More specifically, the lens VL1, which is a planar unipotential lens, is formed by the three electrodes identical to the one shown in FIG. 5B, which are incorporated in the grids G5, G56, and G6, respectively. The elongated beam-guiding hole of each electrode consists of one straight portion having a height av and a width aH, and two sector-shaped portions having a height bv and a width bH. Assuming that the three electron beams are spaced apart at intervals sg, the heights av and bv and the widths aH and bH have the following relationships:

$$aH > 2\,sg + av$$

$$bv > 1.5\,av$$

$$bH > av/2$$

If the heights av and bv, the widths aH and bH, and the interval sg had other relationships, the potential of the end portions of each electrode would focus the electron beams in the horizontal plane, and the side electron beams, in particular, would be deflected.

The relationship specified above are products of the three-dimensional analysis and experiments the inventors hereof have performed and conducted. It is required that the grids G5 and G6 be spaced apart from the auxiliary grid G56 for a distance longer than $1.3 \times av$. If an electrode similar to the one shown in FIG. 5A were located within a distance of 1.3×av, an electric field should leak through the holes made in those plates of the grids G5 and G6 which oppose the auxiliary grid G56, inevitably focusing the electron beams in the horizontal plane.

The dimensional features of the present embodiment will be detailed as follows:

Interval (sg) between cathodes: 4.92 mm

Diameter of holes of G1 and G2: 0.62 mm

Diameter of holes of G3, G4 and G5 faced to the grid G4 : 4.52 mm

Height/width of holes of grids G5, G56, G6, G7, and G8: 5.52 mm/15.0 mm (Height/length of sector-shaped portions: 8.0 mm/2.5 mm)

Diameter of hole of grid G8 faced to the grid G9: 15.0 mm

Diameter of hole of grid G9: 18.0 mm

Lengths of electrodes: G3=1.1 mm; G4=4.4 mm; G5=9.2 mm; G56=8.0 mm; G6=21.0 mm; G7=4.4 mm; G8=37.0 mm; G9=40.0 mm In the embodiment shown in FIG. 3, which is a color cathode-ray tube having a 32-inch screen and a deflection angle of 110°, the optimum voltages of the grids for focusing the electron beams onto the center portion of the screen SCN appropriately are:

8 kV for the grids G3, G5, G6, and G8

1 kV for the grid G4

3 kV for the grid G56

15 kV for the grid G7

25 kV for the grid G9

To focus the beams appropriately onto a peripheral portion of the screen SCN, it suffices to increase the voltage of the grid G5 by 500 V only, to 3.5 kV, whereas it is required to increase the voltage by about 1.0 kV in the conventional color cathode-ray tube. In other words, the color cathode-ray tube apparatus of this invention needs but a relatively low dynamic-focusing voltage. This means that the circuit for driving the apparatus need not include a high dynamic-focusing voltage source, and can therefore be made at low cost.

Figure 5D:
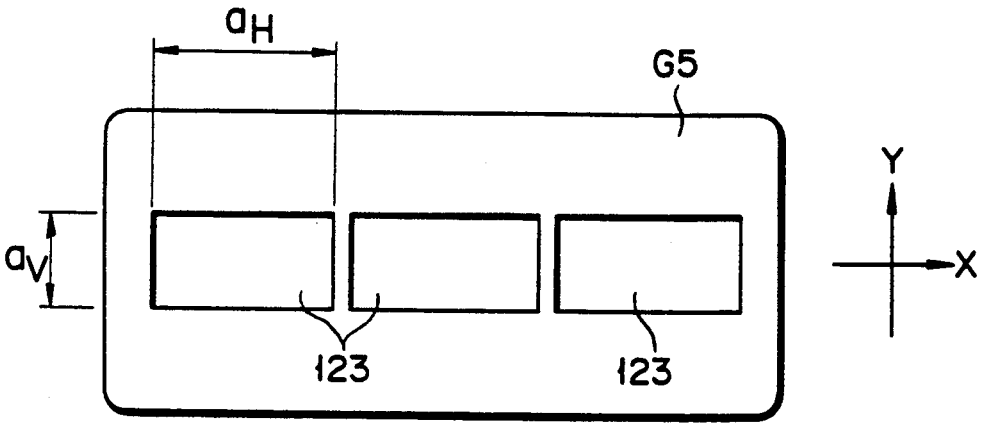

In the embodiment described above, the lens VL1 of a plane type for forming the cross-over CO2 is formed by the electrode which has one elongated hole 122 for allowing three electron beams to pass therethrough. However, it is not limited in this embodiment. In the modification, the electrode G5 may be provided with three elongated holes 123 to form the electron lens, as shown in FIG. 5D. It is preferable in this modification that the aperture ratio between a lateral dimension aH to a longitudinal dimension aV of the hole 123 set to be relatively large value or quadruple lens is formed to apply a divergence force to the electron beams in the horizontal plane, as described below, since the electron beams are not focused only in the vertical plane but also in the horizontal plane.

In the embodiment described above, the electron beams BR, BG, and BB are focused excessively in the vertical plane, inevitably because of the deflection aberration of the beams, caused by the magnetic field generated by the deflection yoke 7. Nevertheless, this excessive focusing is eliminated. Usually the horizontal-deflection aberration of an electron beam is so small that it need not be reduced or eliminated at all. If necessary, however, the horizontal-deflection aberration can be eliminated. For example, that plate of the grid G5 which opposes the grid G4 may be lengthened, and that plate of the grid G5 which opposes the auxiliary grid G56 is shortened, whereby a quadruple lens is formed between the grid G5 and the auxiliary grid G56. This electron lens has a small beam-focusing power. When the electron beams are deflected toward a peripheral portion of the screen SCN, the voltage of the auxiliary grid G56 is increased to decrease the focusing power of the quadruple lens formed between the grids G5 and G56. As a result of this, the electron beams are focused also in the horizontal plane and weakly focused in the vertical plane relative to that in the horizontal plane or diverged in the vertical plane. Since the quadruple lens is much more sensitive than a lens, its focusing power remains sufficiently great even if the potential of the auxiliary grid G56 fluctuates by several hundred volts. Hence, the electron beams directed to a peripheral portion of the screen SCN are focused in the horizontal plane, a little too much. This excessive horizontal focusing of the beams is suppressed by the deflection aberration which the beams have due to the magnetic field generated by the deflection yoke 7. Therefore, a electron beam being applied to any portion of the phosphor screen SCN can be properly focused in both the vertical plane and the horizontal plane.

As is illustrated in FIG. 6C, the cathode-ray tube apparatus has, among other things, the electron lens VL1 for focusing the beams BR, BG, and BB mainly in the vertical plane, thereby forming a second cross-overs CO2 extending in the horizontal direction, and the electron lens LEL for focusing these beams, supplied from the cross-overs CO2, onto the phosphor screen SCN. As can be understood from FIG. 6B, the lens VL1 does not focus the beams in the horizontal plane, thus forming no cross-overs in the horizontal plane between the lens VL1 and the lens LEL.

When the electron beams are deflected by the magnetic field of self-convergence type, the vertical focusing power of the lens VL1 is decreased in proportion to the deflection angle of the beams. The second cross-over CO2 is thereby shifted toward the electron lens LEL, appropriately focusing the electron beams BR, BG, and BB onto the peripheral portion of the phosphor screen SCN.

The electron beams BR, BG, and BB have virtually no deflection aberration in the horizontal direction, or are under-focused in the horizontal plane. Hence, the lens VL1 should better be designed to focus the beams at all or slightly over-focus them in the horizontal plane, when its horizontal-focusing power is reduced in proportion to the deflection angle of the electron beams. At least, the lens VL1 should focus the beams to form cross-overs at positions very close to the electron lens LEL. In view of this, it is desirable that the electron lens LV1 be a lens which focuses beams in the vertical plane only. More specifically, the lens VL1 must have such an electrode as is shown in FIG. 5B, which has one hole 122 elongated in the horizontal direction for guiding three parallel beams spaced apart in the horizontal direction. As has been pointed out, the beam-guiding hole 122 consists of a straight portion and two sector-shaped portions 122', and the electrode has two projections PT extending in the X direction from upper and lower edges of the straight portion of the hole 122. Having this specific configuration, the electrode shown in FIG. 5B focuses the three beams BR, BG, and BB to the same degree in the vertical plane only.

The embodiment described above has other electron lens PL, ELS, and VL2. These lenses are used to adjust the focusing of the beams and to enhance the efficiency of the electron gun assembly, thereby forming small beam spots on the center portion of the phosphor screen SCN.

Figure 8:
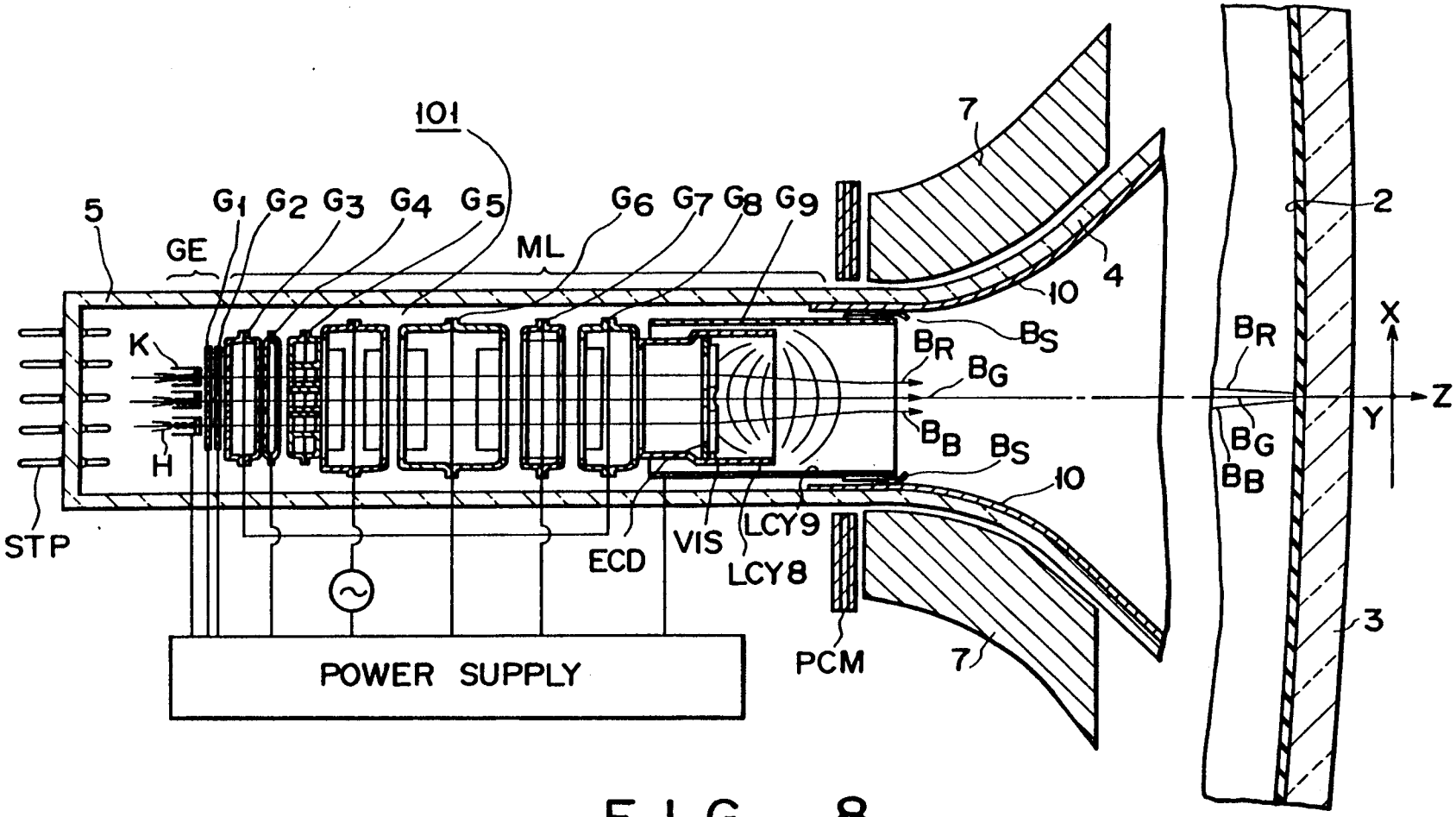
FIG. 8 is a longitudinal sectional view illustrating a color cathode-ray tube apparatus according to another embodiment of this invention.

FIG. 8 illustrates a color cathode-ray tube apparatus, which is another embodiment of the invention. In this figure, the same reference numerals and symbols are used to designate the same components as those shown in FIG. 3. As can be seen from FIG. 8, this embodiment is characterized in two respects. First, the electron gun assembly has no component equivalent to the auxiliary grid G56. Second, the fifth grid G5 is maintained at a low potential of 1 to 3 kV, thus forming an electron lens LV1 between the fifth grid G5 and the six grid G56. This lens VL1 focuses electron beams BR, BG, and BB mainly in the vertical plane. Hence, the electron lens system is, after all, the same as that of the first embodiment.

The potential of the fifth grid G5, which is relatively low, is increased in proportion to the deflection angle of the electron beams. As a result of this, the vertical-focusing power of the lens VL1 is reduced, and the horizontal-focusing power of the cylindrical unipotential lens ELS, formed by the grids G3, G4, and G5, is increased. The increase in the vertical-focusing power of the lens ELS increases the degree of horizontal focusing of the beams which is insufficient because of the deflection aberration imparted to the beams by the self-converging magnetic field generated by the deflection yoke 7. The electron beams are thereby focused appropriately also in the horizontal plane.

Either embodiment described above has an electron gun assembly which has large electron lenses used for focusing three electron beams. Nevertheless, this invention can be applied to a color cathode-ray tube apparatus wherein three identical large electron lenses are used in place of each of such lenses, for focusing the three electron beams, respectively. Moreover, according to the present invention, the electrode shown in FIG. 5B can be replaced by three electrodes, each having an elongated hole, for focusing three electron beams, respectively.

As has been described in detail, the present invention can provide a color cathode-ray tube apparatus, in which three electron beams set in an in-line alignment are focused such that they form a high-quality image on the phosphor screen, despite of the deflection aberration the beams have as they are deflected in the horizontal and vertical directions. In particular, since it suffices to apply a low dynamic voltage to reduce or eliminate the deflection aberration of the beams, the apparatus needs no drive circuits which includes a high-voltage source and is therefore expensive. Furthermore, since the electron lens for reducing or eliminating the deflection aberration of the beams is a cylindrical one, not a quadruple lens, which need not be controlled to adjust its horizontal-focusing power and which is easy to operate and design.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A cathode ray tube apparatus comprising:

an electron gun assembly, having three gun axes aligned in a horizontal plane, for focusing and converging three electron beams;

means for generating horizontal and vertical deflection magnetic fields that deflect the three electron beams emitted from the electron gun assembly in both a horizontal plane and a vertical plane, the horizontal deflection magnetic field being formed as a pincushion-shaped field; and means for emitting red, green and blue light rays when the deflected electron beams impinge thereon;

said electron gun assembly including:

means for emitting three electron beams, the emitting means being arranged in-line in the horizontal plane, along the three gun axes, respectively, for accelerating and controlling the electron beams, and for causing the three electron beams to cross the gun axes thereby defining a dot-like first cross-over on each gun axis;

first electron lens means for focusing the electron beams and having a vertical-lens power in the vertical plane and a horizontal-lens power in the horizontal plane, the vertical-lens power being greater than the horizontal-lens power, thereby causing the three electron beams to cross the gun axes in the vertical plane so as to define line-like second cross-overs extending in the horizontal plane of the gun axes, respectively, wherein said horizontal-lens power remains constant and is not dependent upon deflection of said electron beams;

second electron lens means for focusing the three electron beams on the phosphor screen; and cross-over shifting means for changing the vertical-focusing power, in accordance with horizontal or vertical deflection, thereby shifting the line-like second cross-overs on the gun axes between the first electron lens means and the second electron lens means;

wherein said first and second electron lens means correct for deflection and distortion that is caused by said pincushion-shaped field.

2. The gun assembly according to claim 1, wherein said first electron lens means is formed by an electrode having a plurality of holes, each hole having a horizontal dimension and a vertical dimension smaller than the horizontal dimension.

3. The electron gun assembly according to claim 1, wherein said first electron lens is formed by an electrode having a single hole having a horizontal dimension and a vertical dimension smaller than the horizontal dimension.

4. The electron gun assembly according to claim 1, wherein said second lens is formed by an electrode having a plurality of holes.

5. The electron gun assembly according to claim 1, wherein said second lens is formed by an electrode having at least one common hole.

6. The electron gun assembly according to claim 1, wherein said cross-over shifting means varies the vertical-lens power of said first lens means.

7. A cathode ray tube apparatus, comprising:

an electron gun assembly having three gun axes aligned in a horizontal plane, for focusing and converging three electron beams;

means for generating horizontal and vertical deflection magnetic field to deflect the three electron beams emitted from the electron gun assembly in both a horizontal plane and a vertical plane, the horizontal deflection magnetic field being formed as a pincushion-shaped field; and a phosphor screen for emitting red, green and blue light rays, when the deflected electron beams impinge thereon;

said electron gun assembly including:

three cathodes arranged in in-line alignment for emitting three electron beams along the three gun axes, respectively;

control electrode means, having three round holes, for accelerating and controlling the electron beams which have been emitted by said cathodes, and for causing each of the three electron beams to cross its respective gun axis and thereby define a dot-like first cross-over on each of the gun axes;

first electrode means including electrode structures, which have first plates and second parallel plates facing one another, the first plate being on a cathode side and having three round holes for guiding the three electron beams, respectively, and the second plates being on a phosphor screen side and having a hole elongated in a horizontal direction for guiding the electron beams and for causing each of the three electron beams to cross its respective gun axis in the vertical plane, thereby defining a line-like second cross-over extending in the horizontal plane on each of the gun axes, one of said electrode structures having its second plates being applied with a potential changed in accordance with the horizontal or vertical deflection of the electron beams, and the remaining electrode structures being held at a predetermined potential, thereby shifting the line-link second cross-overs on the gun axes; and second electrode means having one through hole for guiding the three electron beams emerging from the line-like second cross-overs, for focusing the electron beams and also for converging the electron beams while the beams are travelling toward the phosphor screen;

wherein said first and second electrode means correct for deflection and distortion that is caused by said pincushion-shaped field

8. The electron gun assembly according to claim 7, wherein the elongated hole of said second electrode means has a straight portion having a predetermined width and two broad portions continuous to the straight portion.

9. The electron gun assembly according to claim 8, wherein the elongated hole of said electrode means has the following dimensional features:

$$aH > 2\ sg + av$$

$$bv > 1.5\ av$$

$$bH > av/2$$

where av is the height of the straight portion, aH is the width thereof, bv is the height of the broad portions, bH is the width thereof, and sg is the interval at which the electron beams are spaced apart at the elongated hole of said second electrode means.

10. A cathode ray tube apparatus, comprising:

an electron gun assembly, having three gun axes aligned in a horizontal plane;

means for generating horizontal and vertical-deflection magnetic fields to deflect the three electron beams emitted from the electron gun assembly in both the horizontal plane and a vertical plane, the horizontal-deflection magnetic field being formed as a pincushion-shaped field; and a phosphor screen for emitting red, green and blue light rays, when the deflected electron beams impinge thereon;

said gun assembly including:

three cathodes arranged in in-line alignment for emitting three electron beams along the three gun axes, respectively;

control electrode means, including first, second and third grids, each having three round holes, for accelerating and controlling the three electron beams emitted by said cathodes, and for causing each of the three electron beams to cross their respective gun axis to thereby define a dot-like first cross-over on each of the gun axes;

first electrode means for guiding the three electron beams and for causing each of the three electron beams to cross their respective gun axis in the vertical plane to thereby define a line-like second cross-over extending in the horizontal plane on each of the gun axes, the first electrode means including a fourth grid having three round holes for guiding the three electron beams, respectively, a fifth grid having first and second plates having a space therebetween, the first plate having three round holes for guiding the three electron beams, respectively, and the second plate having a hole elongated in the horizontal direction, for guiding the three electron beams, the fifth grid being applied with a potential varied in accordance with the horizontal or vertical deflection of the electron beams and the fourth grid and a sixth grid being held at a predetermined potential, thereby shifting the line-like second cross-overs on the gun axes; and second electrode means one through hole for guiding the three electron beams, for focusing the electron beams emerging from the line-like second cross-overs and also for converging the electron beams while the beams are traveling toward the phosphor screen;

wherein said first and second electrode means correct for deflection and distortion that is caused by said pincushion-shaped field.

11. The electron gun assembly according to claim 10, wherein the elongated hole of the fifth grid has a straight portion having a predetermined width and two broad portions contiguous with the straight portion.

12. The electron gun assembly according to claim 11, wherein the elongated hole of the fifth grid has the following dimensional features:

$$aH > 2\ sg + av$$

$$bv > 1.5\ av$$

$$bH > av/2$$

where av is the height of the straight portion, aH is the width thereof, bv is the height of the broad portions, bH is the width thereof, and sg is the interval at which the electron beams are spaced apart at the fifth grid.

13. A cathode ray tube apparatus, comprising:

an electron gun assembly, having three gun axes aligned in a horizontal plane;

means for generating horizontal and vertical-deflection magnetic fields to deflect the three electron beams emitted from the electron gun assembly in both the horizontal plane and a vertical plane, the horizontal-deflection magnetic field being formed in a pincushion type; and means for emitting red, green and blue light rays, when the deflected electron beams impinge thereon;

said electron gun assembly including:

three cathodes in in-line alignment for emitting three electron beams along the three gun axes, respectively;

control electrode means, including first, second and third grids, each having three round holes for accelerating and controlling the electron beams which have been emitted by said cathodes, and causing each of the three electron beams to cross their respective gun axis to thereby define a dot-like first cross-over on each of the gun axes;

first electrode lens means for guiding the three electron beams and causing each of the three electron beams to cross their respective gun axis in the vertical plane, thereby defining a line-like second cross-over extending in the horizontal plane on each of the gun axes, the first electrode means including a fourth grid having three round holes for guiding the three electron beams, respectively, a fifth grid having first and second plates with a space therebetween, the first plate having three round holes for guiding the three electron beams, respectively, and the second plate having a hole elongated in the horizontal direction, for guiding the three electron beams, a sixth grid having a hole elongated in the horizontal direction, and an auxiliary grid located between the fifth grid and the sixth grid and having a hole elongated in the horizontal direction for guiding the three electron beams, the auxiliary grid being applied with a potential that is varied in accordance with the horizontal or vertical deflection of the electron beams, and the fourth, fifth and sixth grids being held at a predetermined potential, thereby shifting each of the line-like second cross-overs on each of the gun axes; and second electrode lens means having one through holes for guiding the three electron beams, for focusing the electron beams emerging from the line-like second cross-overs and also converging the electron beams while the beams are traveling toward the phosphor screen;

wherein said first and second electrode lens means correct for deflection and distortion that is caused by said pincushion-shaped field.

14. The electron gun assembly according to claim 13, wherein the elongated hole of the fifth grid has a straight portion having a predetermined width and two broad portions contiguous with the straight portion.

15. The electron gun assembly according to claim 14, wherein the elongated hole of the fifth grid has the following dimensional features:

$$aH > 2\ sg + av$$

$$bv > 1.5\ av$$

$$bH > av/2$$

where av is the height of the straight portion, Ah is the width thereof, bv is the height of the broad portions, bH is the width thereof, and sg is the interval at which the electron beams are spaced apart at the fifth grid.

* * * * *